United States Patent [19]

Bruney

[11] Patent Number: 4,495,637

[45] Date of Patent: Jan. 22, 1985

[54] APPARATUS AND METHOD FOR ENHANCED PSYCHOACOUSTIC IMAGERY USING ASYMMETRIC CROSS-CHANNEL FEED

[75] Inventor: Paul F. Bruney, Silver Spring, Md.

[73] Assignee: Sci-Coustics, Inc., Washington, D.C.

[21] Appl. No.: 491,297

[22] Filed: May 3, 1983

Related U.S. Application Data

[63] Continuation-in-part of Ser. No. 401,211, Jul. 23, 1982.

[51] Int. Cl.[3] ..... H04R 5/00; H04S 1/00

[52] U.S. Cl. ..... 381/1; 381/18

[58] Field of Search ..... 381/1, 17, 18, 24

[56] References Cited

U.S. PATENT DOCUMENTS

| | | | |
|---|---|---|---|
| 3,170,991 | 2/1965 | Glasgal | 381/1 |
| 4,121,059 | 10/1978 | Nakabayashi | 381/1 X |
| 4,139,728 | 2/1979 | Haramoto et al. | 381/1 |
| 4,149,036 | 4/1979 | Okamoto et al. | 381/1 |
| 4,192,969 | 3/1980 | Iwahara | 381/1 |
| 4,309,570 | 1/1982 | Carver | 381/1 |

FOREIGN PATENT DOCUMENTS

| | | | |
|---|---|---|---|
| 111400 | 9/1981 | Japan | 381/1 |

*Primary Examiner*—R. J. Hickey

*Attorney, Agent, or Firm*—Cushman, Darby & Cushman

[57] ABSTRACT

Enhanced pyschoacoustic imagery is achieved in an audio signal processing circuit for processing plural channels of related audio signals. Asymmetric bi-directional audio signal cross-feed is established between first and second audio signal processing channels, for example. The cross-fed signal components are combined in an out-of-phase relationship with respect to related audio signals already passing through a given channel. The asymmetry is designed so as to complement the asymmetry which is believed to be present in a listener's brain processing of perceived acoustic signals due to the naturally occurring left or right half brain dominance of the listener. In other embodiments both symmetric and asymmetric, cross-feeding is limited to signal components below a predetermined frequency.

24 Claims, 6 Drawing Figures

X1 >> X2 FOR DOMINANT RIGHT HALF BRAIN LISTENERS
X2 >> X1 FOR DOMINANT LEFT HALF BRAIN LISTENERS

TYPICAL RIGHT-HANDED ASYMMETRIC CROSS-FEED CIRCUIT

APPARATUS AND METHOD FOR ENHANCED PSYCHOACOUSTIC IMAGERY USING ASYMMETRIC CROSS-CHANNEL FEED

This is a continuation-in-part of application Ser. No. 401,211, filed 7-23-82, the contents of which are incorporated herein by reference.

This invention is generally directed to apparatus and method for processing plural channels of related audio signals such as stereophonic, quadraphonic, etcetera. In particular, this invention is directed to apparatus and method for providing more accurately located psychoacoustic images when related (e.g., prerecorded) signals in such plural channels are simultaneously processed and transformed to plural corresponding acoustic signal sources by respectively corresponding electro-acoustic transducers.

The general problem of faithfully recording (or transmitting) a naturally occurring field of acoustic signals and of faithfully reproducing an identically perceived field of such acoustic signals in another location is quite old in the art. There are a multitude of various stereophonic, quadraphonic and other sound reproduction systems which attempt with varying degrees of success to achieve such a desired result. However, as the continued proliferation of new and/or alternate sound reproduction systems continues, it is apparent that no perfect solution has yet been achieved.

Typical prior art sound reproduction systems provide left and right stereophonic signal processing channels and corresponding loudspeakers. The illusion of an acoustic image placed at its proper location (i.e., to the right, to the left, in the center, etcetera, with respect to the speakers) is attempted using only balanced and symmetric circuitry. That is, the circuitry is symmetrically organized such that if the left and right input channels are reversed and if the left and right speaker positions are also reversed, an identical psychoacoustic effect will nevertheless be created in a listener's mind. This observation is also true for systems using three, four or more loudspeaker systems. Some examples of these prior art symmetric or balanced circuits may be seen by examining the following identified prior issued U.S. patents:

U.S. Pat. No. 3,246,081—Edwards—(1966)
U.S. Pat. No. 3,725,586—Iida—(1973)
U.S. Pat. No. 3,883,692—Tsurushima—(1975)
U.S. Pat. No. 3,911,220—Tsurushima—(1975)
U.S. Pat. No. 3,916,104—Anazawa et al.—(1975)
U.S. Pat. No. 3,925,615—Nakano—(1975)
U.S. Pat. No. 4,027,101—DeFreitas et al.—(1977)
U.S. Pat. No. 4,087,629—Atoji et al.—(1978)
U.S. Pat. No. 4,087,631—Yamada et al.—(1978)
U.S. Pat. No. 4,097,689—Yamada et al.—(1978)
U.S. Pat. No. 4,149,036—Okamoto et al.—(1979)
U.S. Pat. No. 4,192,969—Iwahara—(1980)
U.S. Pat. No. 4,209,665—Iwahara—(1980)
U.S. Pat. No. 4,219,696—Kogure et al.—(1980)
U.S. Pat. No. 4,303,800—DeFreitas—(1981)
U.S. Pat. No. 4,309,570—Carver—(1982)

In the most simple two speaker versions of these prior art reproduction systems, pyschoacoustic image enhancement is usually accomplished in an attempt to place the outermost reproduced acoustic images beyond the actual physical locations of the left and right loudspeakers. To achieve this enhancement, such circuits typically use either symmetric phase shift or phase inversion, symmetric variation in gain or combinations of both sometimes in concert with frequency tailoring, time delay, and/or compression or expansion.

With symmetric phase shifting or phase inversion, the stereo signal typically consists of a predominating channel signal appearing on one loudspeaker while the same signal appears in the opposite speaker but lower in amplitude and out-of-phase. The relative change in amplitudes and phases is *exactly* the reverse when the opposite channel dominates by the same amount. Accordingly, such circuits may be termed "symmetric" using the previously stated definition. They also tend to create a "hole-in-the-middle" effect when the listener is situated between the stereo speakers.

When symmetric gain variations are utilized, the predominating channel signal is increased in level while the weaker channel level is decreased in level. Again, the relative magnitude of gain variations is exactly the reverse when the opposite channel predominates by the same amount thus once again providing a "symmetric" circuit in the sense previously described.

Most of the above-identified prior issued U.S. patents obviously disclose such symmetric circuitry insofar as their relevant portions are concerned. Others (such as Kogure et al. '696) may initially appear to provide asymmetric cross-feed between various channels (e.g., see FIG. 11 thereof). However, when examined more closely, even these are seen to actually comprise only symmetric circuits in the sense previously described.

All prior art commercial systems have been criticized for creating poorly defined psychoacoustic images, weak center stage psychoacoustic images (i.e., the "hole-in-the-middle" effect) or, especially in cases where expansion or compression functions are used, psychoacoustic images which do not remain stationary. Furthermore, those commercial systems which provide cross-feeding do so over a broad range of frequencies.

It has now been discovered that enhanced psychoacoustic imagery may be achieved in a plural channel sound reproduction system by purposefully providing asymmetric cross-feed between the channels. It is believed that such enhanced capability may be due to the fact that asymmetric cross-feed of this type complements a natural asymmetric preference which may exist in the processing of perceived acoustic signals by the human mind.

This suspected asymmetry in the mental processing of perceived acoustic signals is in agreement with some facts already known about human hearing. For instance, it is already known that the right ear of naturally "right-handed" humans is coordinated primarily with the left hemisphere of the brain—where language and speech centers are located. By contrast, for such naturally "right-handed" people, the left ear is normally naturally coordinated primarily with the right or "holistic" half of the brain. Therefore, the right ear is probably better accommodated for hearing speech while the left ear is probably better accommodated for hearing music. Furthermore, some preliminary masking level difference (MLD) tests have shown an asymmetry in the human brain stem response to acoustic stimuli applied to the left and right ears respectively. Since each half of the human brain receives signals for processing from both ears, it is believed reasonable to suppose that an asymmetry in the comparison ratios may exist between the left and right hemispheres of the brain.

In accordance with this invention, a plural channel audio signal processing circuit is especially configured with asymmetric cross-feed between the channels so as to better complement listeners having a predetermined dominant half brain. Accordingly, while one asymmetric circuit dimensioning is preferred for naturally right-handed people (having a dominant left brain half), another different dimensioning of the asymmetric circuitry is preferred for naturally left-handed people (having a dominant right brain half).

The ability of humans to mentally localize or "image" the relative angular location of an acoustic sound source depends upon relative volume differences heard between the listener's left and right ears and upon phase differences between the acoustic signals impinging upon the left and right ears below about 1500 Hertz. (This is actually a function of the spacing between left and right ears for a given person.) Volume level changes common to both left and right ears are interpreted as distance changes. Since stereophonic sound reproduction does not inherently reproduce appropriate relative volume and/or phase differences throughout the reproduced acoustic fields which humans would naturally perceive in the original acoustic field environment, this shortcoming must somehow be compensated if true psychoacoustic imagery realism is to be achieved.

Contrary to symmetric prior art approaches, the present invention provides different relative volume levels for the "in-phase" and the "out-of-phase" output signals in the left or right channel for equivalent magnitude predominate left or right channel input signals. Prior art approaches inherently assume that such an asymmetry in responses to equally predominant left and right channel signals would produce corresponding left and right psychoacoustic images that would be perceived by the listener to be placed at different relative angles. However, it has now been discovered that this conventional wisdom is, in fact, not the case. Rather, such asymmetrical or different "in-phase" and "out-of-phase" relative signal volume levels have been empirically derived so as to produce identical perceived angles between complementary psychoacoustic images. These empirical results tend to confirm the existence of an asymmetry in a listener's ability to localize psychoacoustic images from acoustic inputs to the left and right ears.

After such asymmetry is established empirically, the input signal of one channel is reduced so that, for a monaural input (one in which both channel input signals are identical), the apparent psychoacoustic image is placed exactly midway between the left and right loudspeakers. In this way, the subjective "hole-in-the-middle" effect is reduced.

In accordance with this invention, a high fidelity stereophonic sound reproduction system is provided with improved psychoacoustic image separation and sharpness—even when those images are positioned outside the boundaries described by the left and right stereophonic loudspeakers. At the same time, images reproduced in the median plane of the listener (e.g., between the left and right loudspeakers) continue to be sufficiently strong to avoid the "hole-in-the-middle" defect noticeable in many prior art systems. Such an improved sound reproduction system in accordance with this invention uses asymmetric stereo channel level differences (i.e., asymmetric gain for the resultant "in-phase" channel throughput) and/or asymmetric volume level cross-feed of "out-of-phase" signal from one stereo channel to the other so as to accurately place psychoacoustic images in their correct original relative locations: in front, behind, inside, beyond, below, or above the left and right stereo loudspeakers.

In accordance with one exemplary embodiment of this invention, asymmetric level differences are provided between left and right stereophonic channels so that, for a given predominating channel, the stronger "in-phase" channel signal appears at a relatively higher volume level in its corresponding loudspeaker while an "out-of-phase" version of that same audio signal appears at some relatively lower volume level in the opposite loudspeaker. However, when the opposite channel predominates by the same amount, these relatively increased and decreased volume level changes are now dissimilar—i.e., the circuit is in this respect asymmetric. The asymmetry is empirically dimensioned such that psychoacoustic images may be clearly localized at equal angles beyond the left and right loudspeakers. Preferably, the asymmetric circuit employed is of relatively simple construction while yet providing the ability to produce accurately localized psychoacoustic images in their correct respective original positions relative the original recording microphones throughout a 360° spherical volume disposed about the listener (i.e., the listener is psychoacoustically placed in the positions of the microphones).

It has also now been discovered that under dynamic operating conditions with incoming stereo musical waveforms, an audible reduction of separation occurs for frequency components above 1500 Hz. Furthermore, when cross-feeding of either a symmetric or an asymmetric nature is provided to enhance separation, the cross-feeding between channels produces distortion products at frequencies above 1500 Hz.

Thus, ideally, according to the present invention, cross-feeding between channels should be limited to frequency components of input signals below 1500 Hz. However, as a result of the simplicity of the preferred embodiments of the present invention disclosed herein, a gain difference exists in the circuits for monaural input signals as compared to when only a single channel is provided with an input signal. For this reason, if signal components above a certain frequency are not cross-fed between channels, the gain of the higher frequency components will not always be the same as the gain of the lower frequency components. Further, causing the gains of signals through the cross-feed stages to be dependent upon frequency tends to reduce a desired "head shadow" effect (an amplitude differential between channels to simulate the reduced amplitude of an audio wave received by an ear away from the source due to the blocking effect of the head) for higher frequencies, which is a desirable feature.

As a result, in several embodiments of the present invention, cross-feeding between channels is limited to frequency components below 10 KHz. That is, frequency components above 10 KHz are not crossfed between channels, or at least the gain of the cross-fed signals is greatly reduced. This represents a compromise between the fact that distortion products are produced when cross-feeding occurs above 1500 Hz and the fact that the illustrated embodiments of the present invention will cause the gains of signal components below the critical frequency to be different from the gains of the frequency components above the critical frequency. The ear of a listener does not sense the gain change above 10 KHz as readily as if the critical frequency were lower. At the same time, audio distortion products are reduced, and the improvement in separation is noticeable while still retaining some "head shadow" effect.

In the most preferred embodiment, the crossfeeding is asymmetric.

These as well as other objects and advantages of this invention will be more completely understood and appreciated by a careful reading of the following detailed description of the presently preferred exemplary embodiment of this invention taken in conjunction with the accompanying drawings, of which:

Figure 3:
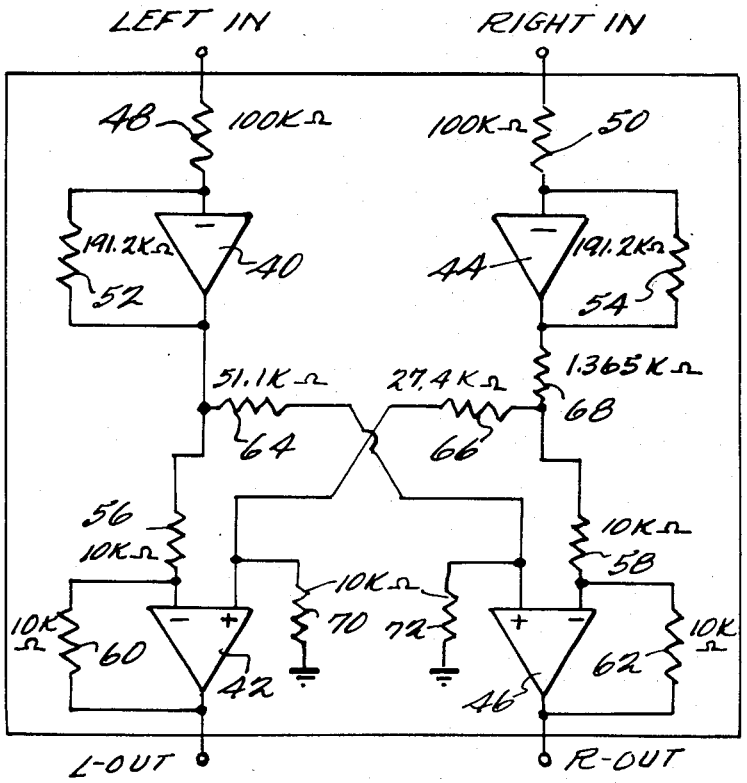
FIG. 3 is a detailed electrical schematic diagram of one specific exemplary embodiment of the asymmetric cross-feed circuit shown in FIGS. 1 and 2.
Figure 4:
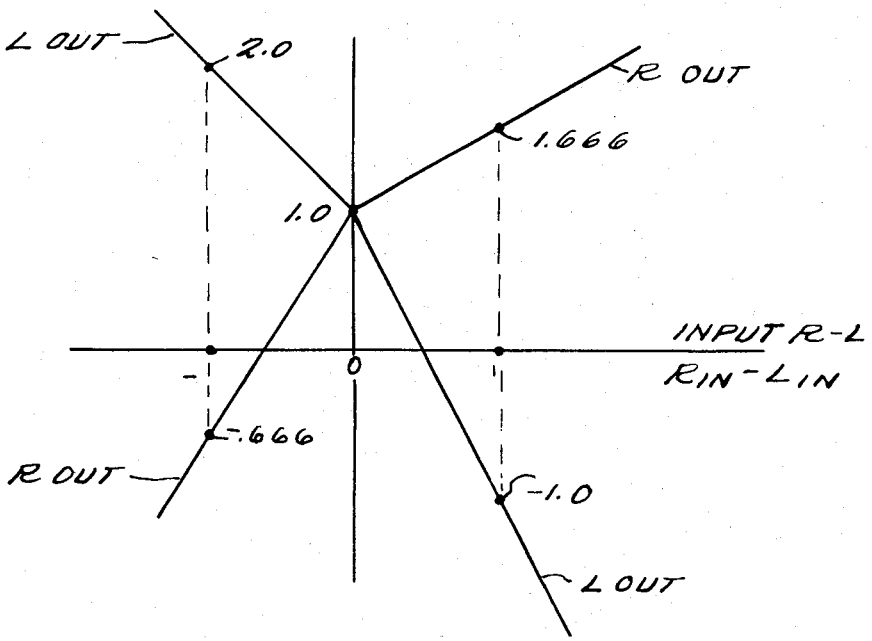
Figure 5:
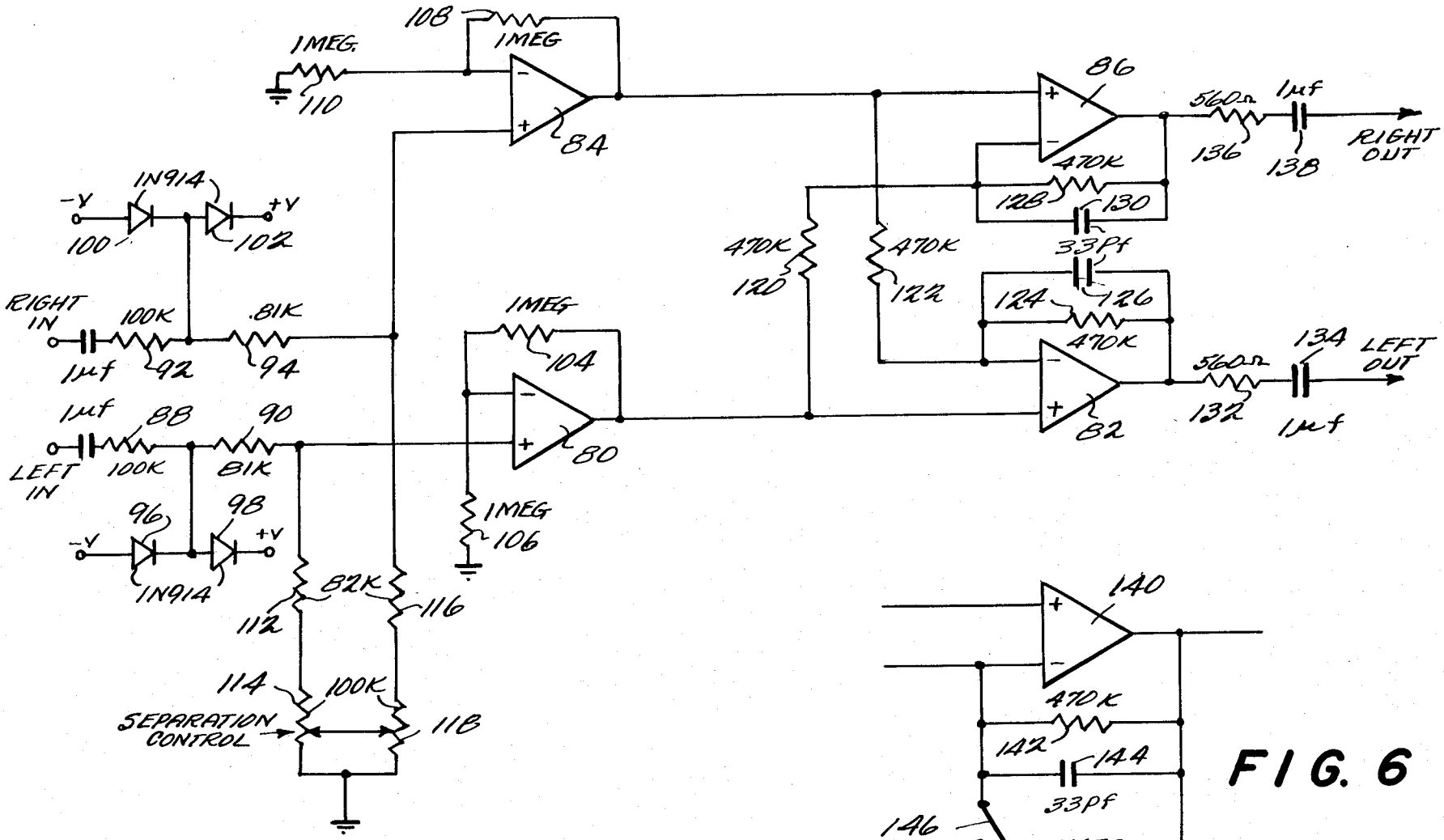
Figure 6:
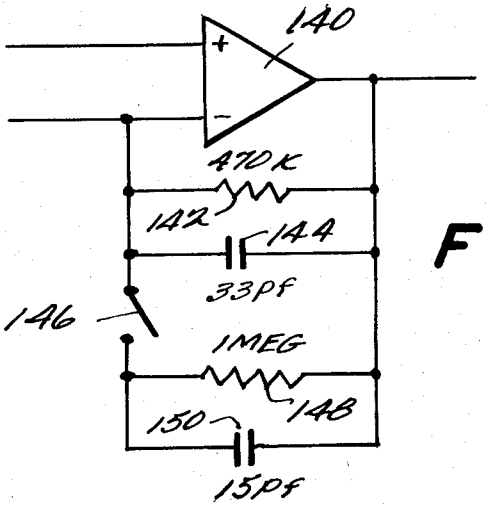

FIG. 4 graphically depicts asymmetric frequency independent gain factors for the exemplary embodiment of FIG. 3;

FIG. 5 is a detailed electrical schematic diagram of a specific exemplary embodiment of the present invention with a symmetric cross-feed limited to below a predetermined frequency; and FIG. 6 is a detailed electrical schematic diagram of a modification for the circuit of FIG. 5 to introduce asymmetric cross-feed below the predetermined frequency, resulting in the most preferred embodiment of the present invention.

Figure 1:
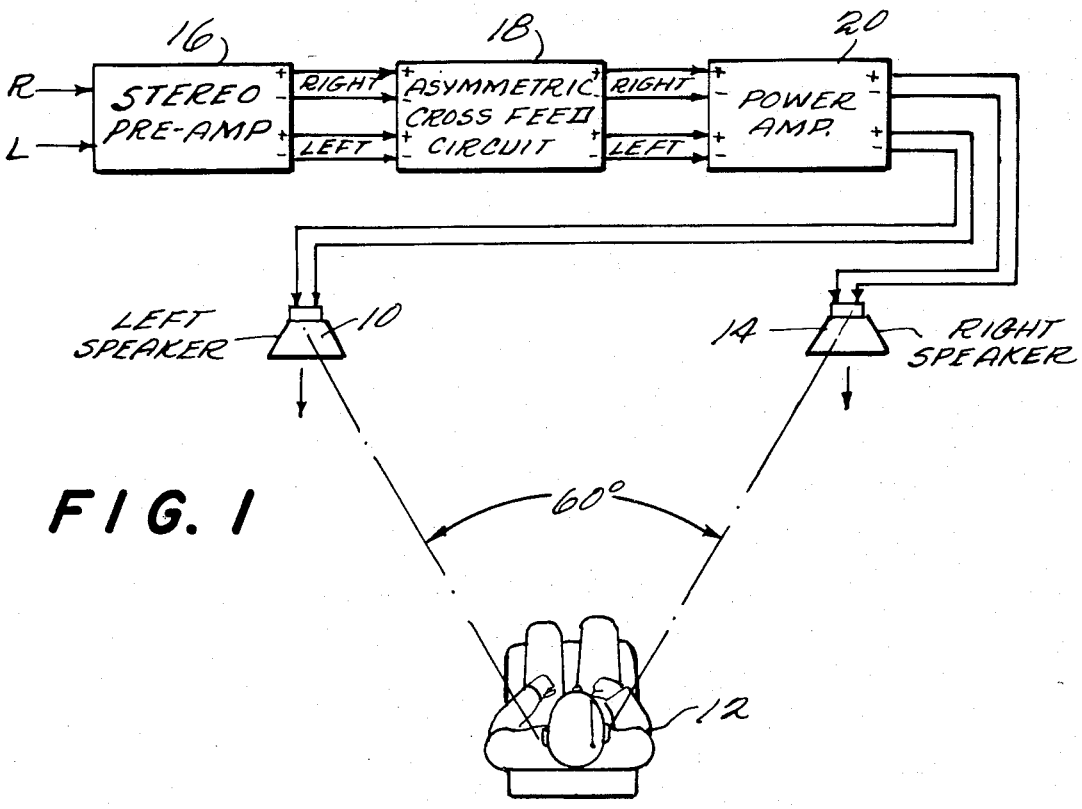
FIG. 1 is a schematic depiction of a typical stereophonic sound reproduction system including an asymmetric cross-feed circuit in accordance with this invention.

A typical stereophonic speaker/listener geometry is depicted in FIG. 1. Here, the left speaker 10 is located to the left of listener 12 while the right speaker is located to the right of listener 12. The angle subtended at the listener location by these two speakers is, in the example shown at FIG. 1, approximately 60°. The speakers are assumed to be directed straightforwardly as depicted by arrows in FIG. 1 and the listener is assumed to be directed along a line bisecting the angle subtended by the speakers as also depicted in FIG. 1.

The specific exemplary dimensions for asymmetric circuitry described below with respect to the exemplary embodiment illustrated in FIGS. 2–4 were derived for the geometry shown in FIG. 1. For different subtended angles and/or for different relative listener locations, etcetera different specific asymmetric dimensioning of the circuit components would be expected. Continuously variable and/or switch-selected variable dimensions for the relevant circuit components may be provided if desired so as to permit a listener to readjust the asymmetric circuit dimensions for a particular speaker/-listener geometry as should be apparent in view of the following disclosure. Furthermore, although the exemplary embodiment is depicted as a separate modular component device, those in the art will recognize that it could just as well be embedded within other system components such as radio receivers, radio transmitters, tuners, amplifiers, etcetera.

A conventional stereophonic signal source (e.g., tape deck, turntable, radio receiver, etcetera) typically provides right and left channel input signals to a conventional stereo preamplifier 16 in the system of FIG. 1. The output of the stereo preamplifier 16 is then fed to a special asymmetric cross-feed circuit 18 constructed in accordance with this invention. The right and left channel outputs from the asymmetric cross-feed circuit 18 are then fed through a conventional power amplifier 20 to drive respective right and left loudspeakers 14 and 10 as should be apparent.

Figure 2:
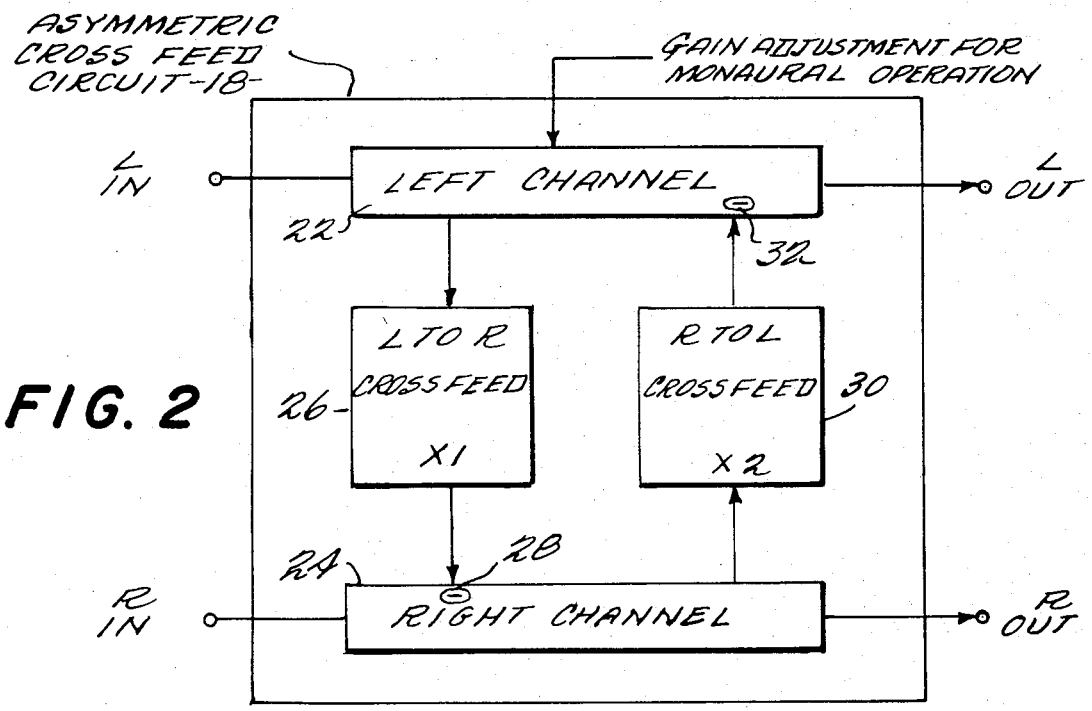
FIG. 2 is a generalized block diagram of the asymmetric cross-feed circuit utilized in FIG. 1.

An exemplary block diagram of the asymmetric cross-feed circuit 18 is shown in somewhat more detail at FIG. 2. Here, a left audio signal processing channel 22 accepts left channel input audio signals as shown and passes them with a predetermined gain factor to a left output terminal. Similarly, a right audio frequency signal processing channel 24 is provided to accept right channel input audio signals and to pass them with a predetermined gain factor to a right channel output terminal. In addition, a left-to-right cross-feed circuit 26 is provided so as to extract a predetermined sample proportion X1 of the audio signal passing through the left channel 22 and to combine such signal at an auxiliary phase inverting input 28 of the right channel 24. (Alternatively, the cross-feed circuit 26 might itself provide the requisite phase change.) A similar right-to-left cross-feed circuit 30 is provided for feeding signals from the right channel 24 to a phase inverting input 32 of the left channel 22. However, the predetermined sample proportion X2 of the right channel signal cross-fed to the left channel is different than the proportion X1 fed from the left channel to the right channel. As denoted in FIG. 2, the proportion X1 is preferably substantially larger than the proportion X2 for listeners in the geometry of FIG. 1 having a dominant right half brain (i.e., naturally left-handed people). On the other hand, the proportion X2 is preferably substantially larger than the proportion X1 for listeners having a dominant left-half brain (i.e. for naturally right-handed persons).

An ideal implementation of the circuitry shown in FIG. 2 would take the Fletcher-Munson effect into full consideration. Briefly stated, the Fletcher-Munson effect involves a realization that humanly perceived acoustic loudness levels are a function of both frequency and the intensity of an acoustic signal presented to the human ear. However, since the frequency factor of the Fletcher-Munson effect varies considerably from one individual to the next, the presently preferred exemplary embodiment of the FIG. 2 circuitry is substantially frequency independent. That is, in the presently preferred exemplary embodiment, only relative amplitude levels are controlled. While the presently preferred exemplary embodiment also utilizes only linear circuitry, it is of course possible that non-linear circuits of various kinds could be devised in accordance with the general principles of this invention.

The specific frequency independent linear circuitry shown in FIG. 3 constitutes an exemplary embodiment of the asymmetric cross-feed aspect of this invention for the speaker/listener geometry shown in FIG. 1. Here, the left channel signal processing circuit includes a cascaded pair of amplifiers 40, 42 while the right channel processing circuitry comprises a similar pair of cascaded amplifiers 44, 46. Amplifiers 40 and 44 are conventional buffer amplifiers having the usual input resistors 48 and 50 respectively, and gain-determining feedback resistors 52 and 54, respectively. Insofar as the "in-channel" signals are concerned, amplifiers 42 and 46 also have the usual input resistors 56 and 58, respectively, and gain-determining feedback resistors 60 and 62, respectively. Although the "in-channel" audio signals are inverted by each of the amplifiers, since a pair of such amplifiers is provided in each channel, the input and output signals for this portion of each channel circuitry will still be "in-phase" as should be appreciated.

It will be noted that the amplifiers 42 and 46 in each of the left and right channels shown in FIG. 3 include a second differential input terminal so that cross-fed signals from the opposite channel may be combined in an "out-of-phase" relationship with respect to the in-channel signals. Left-to-right channel cross-feed is provided by resistor 64 connected from the output of amplifier 40 to the non-inverting differential input of amplifier 46. Similarly, right-to-left cross-feed is provided by resistor 66 connected (through a monaural balancing resistor 68) to the output of amplifier 44 and the non-inverting differential input of amplifier 42. The non-inverting differential inputs of amplifiers 42 and 46 are referenced to ground conventionally via resistors 70 and 72 as should be apparent to those in the art.

As should also be apparent from FIG. 3, because the cross-fed signals are taken from between the cascaded pair of inverting amplifiers in each channel, they can be considered out-of-phase with respect to in-channel signals when combined therewith through the non-inverting inputs of amplifiers 42 and 46.

The resistance values for resistors 64 and 66 will determine the relative volume levels for the "out-of-phase" signals that are cross-fed from one channel to the other. They also constitute suitable input resistors for the non-inverting inputs of the differential amplifiers 42 and 46 as should be apparent. The resistance value for resistor 68 is chosen so as to produce balanced monaural operation thus guaranteeing a center-stage placed psychoacoustic image for a true monaural input signal.

The values of resistors 64, 66 and 68 depicted in FIG. 3 have been empirically derived for optimum performance with the speaker/listener geometry of FIG. 1 for a naturally right-handed person (i.e., having a dominant left-half brain). The values for these three resistors can be expected to change with different speaker/listener geometry (e.g., loudspeaker separation, "tow-in" or inward angling of the loudspeakers, etcetera) and for listeners having a dominant right brain half. Of course, as should now be apparent, the location of the monaural balancing resistor 68 may have to be changed to the right channel for some situations so as to obtain balanced outputs with balanced inputs.

The amplifiers shown in FIG. 3 are of conventional design. One suitable conventional commercially available amplifier which may be utilized in the circuit of FIG. 3 is presently available in integrated circuit form as integrated circuit type MC34004AP.

Generally speaking, for larger subtended speaker angles than the 60° exemplary embodiment shown in FIG. 1, it may be expected that the cross-feed resistors will be larger because less out-of-phase cross-feed should be required and vice versa.

For the specific dimensioning depicted in the FIG. 3 exemplary embodiment, the following linear gain relationships between input and output signals are provided:

1. With a unity strength input signal to the left channel only, the output of the left channel will be two units while the output of the right channel will be −0.666 unit (i.e., out-of-phase).
2. With a unity strength input signal to the right channel only, the right channel output will be 1.666 units while the left channel output will be −1.0 unit (i.e., out-of-phase).
3. With equal unity strength signal inputs to both channels (i.e. monaural input), the output from both the left and the right channels will be of unity strength.

This relationship between input and output signals is graphically depicted at FIG. 4 so that the exemplary asymmetric relationships can be graphically appreciated. Even though the circuitry of FIG. 3 does produce such asymmetry in its left and right output signal levels, appropriate left and right images are nevertheless correctly perceived by a "right-handed" person as being equal because of the apparently asymmetric way in which the resulting acoustic signals from the left and right channels are psychoacoustically added in the listener's brain.

For "right-handed" listeners (people who have a dominant left brain hemisphere), the exemplary circuit of FIG. 3 produces extremely clear sound with extremely wide perceived horizontal angles between widely separated psychoacoustic images. In addition, the listener has also been discovered to obtain accurate vertical psychoacoustic imaging with this exemplary embodiment. The vertical information is most accurately recovered with the circuitry of FIG. 3 when the related audio signals in the stereophonic channels are originally obtained (e.g., for recording purposes) with stereophonic microphones having cardioid pick-up patterns. Such cardioid pick-up patterns are believed to closely approximate the human vertical hearing sensitivity field.

If the channel roles of the FIG. 3 circuitry are reversed, clarity and perceived horizontal and vertical angles are reduced. However, for people with a dominant right brain hemisphere (i.e., true naturally left-handed persons), the opposite is true.

As should now be appreciated, by purposefully providing asymmetric cross-feed between plural channels of related audio signals, it is possible to complement the asymmetric psychoacoustic signal imaging process of the human brain so as to produce more accurately reproduced psychoacoustic imagery for the listener. While the exemplary embodiment utilizes a stereophonic two-loudspeaker system, similar asymmetry may be incorporated into three, four or any other multiple number of speaker reproduction systems and possibly also embellished with other circuits such as volume enhancement (for some angular portion of the perceived free field), frequency tailoring, etcetera. Nevertheless, the principles of this invention may be employed in such a system for achieving enhanced psychoacoustic imagery. Similarly, the principles of this invention may be applied to hearing aids so as to enhance psychoacoustic image localization and/or for psychoacoustically increasing the perceived volume level heard by the ear in which a signal is more dominant.

As indicated above, under dynamic operating conditions with incoming stereo music waveforms, an audible reduction of separation occurs for frequencies above 1500 Hz. Furthermore, cross-feeding channel frequency components above 1500 Hz generates distortion products. Therefore, it has now been discovered that cross-feeding between channels should be frequency limited, whether the cross-feeding is symmetrical or asymmetrical. FIG. 5 illustrates a symmetric cross-feed imaging circuit which substantially limits cross-feeding to those frequency components below 10 KHz. Opposing performance considerations in the circuit illustrated in FIG. 5 have resulted in the selection of 10 KHz being the critical frequency. As indicated above, cross-feeding frequency components above 1500 Hz produces undesirable distortion products. However, because of the simplicity of the circuits illustrated in FIGS. 3 and 5, a gain difference exists when a monaural input signal is applied to both channels, as compared to when an input signal is applied to only one channel. For this reason, if signals above a certain frequency are not cross-fed between channels, the gains of frequency components above the critical frequency will not always equal the gains of frequency components below the critical frequency. Furthermore, adjusting the gains of signals through the cross-feed circuitry tends to reduce a desired "head shadow" effect for higher frequencies, which is a desirable feature. The 10 KHz critical frequency was selected since the ear of a listener does not sense the gain change above 10 KHz as readily as if the critical frequency were lower. At the same time, audible distortion products are reduced, and the improvement in separation is noticeable while still retaining some "head shadow" effects.

In FIG. 5, the left channel signal processing circuit includes a cascaded pair of amplifiers 80 and 82 while the right channel processing circuitry comprises a similar pair of cascaded amplifiers 84 and 86. Amplifiers 80 and 84 are conventional buffer amplifiers, with amplifier 80 having the usual input resistors 88 and 90 and amplifier 84 having the usual input resistors 92 and 94. Right and left channel signals are AC-coupled to the input resistors. Diodes 96 and 98 are connected in series from a negative voltage source to a positive voltage source. The interconnection between diodes 96 and 98 is connected to the interconnection between resistors 88 and 90. Diodes 96 and 98 prevent excessive voltages from being applied to the input of amplifier 80. Similarly, diodes 100 and 102 are connected between resistors 92 and 94 to protect the input of amplifier 84.

The input signals through resistors 88 and 90 are applied to the non-inverting input of amplifier 80. Associated with amplifier 80 are the usual gain-determining feedback resistors 104 and 106 interconnecting the output of amplifier 80 to the inverting input. Similarly, input signals for the right channel are applied to the non-inverting input of amplifier 84. Resistors 108 and 110 control the gain of amplifier 84.

Provided with the embodiment illustrated in FIG. 5 is a network for controlling the degree of separation, connected between the non-inverting inputs of amplifiers 80 and 84. Thus, the non-inverting input of amplifier 80 is connected through resistor 112 to a terminal of potentiometer 114. The non-inverting input of amplifier 84 is connected through resistor 116 to a terminal of potentiometer 118. The other fixed terminals of potentiometers 114 and 118 are grounded, and the center tabs of potentiometers and 114 and 118 are connected together. With this interconnection of potentiometers 114 and 118, the degree and nature of separation can be controlled to a very fine degree.

The outputs of amplifiers 80 and 84 are connected to the non-inverting inputs of amplifiers 82 and 86, respectively. The inverting inputs of amplifiers 82 and 86 receive signals from the opposite channel. Thus, the outputs of amplifiers 80 and 84 are applied through resistors 120 and 122, respectively, to the inverting inputs of amplifiers 86 and 82, respectively. As a result, cross-fed signals from the opposite channel are combined in amplifiers 82 and 86 in an "out-of-phase" relationship with respect to the in-channel signals.

As indicated above, an important aspect of this embodiment of the present invention is the reduction of gain of the cross-fed signal components at frequencies higher than 10 KHz. This is accomplished in the embodiment illustrated in FIG. 5 by the provision of feedback networks consisting of a resistor and a capacitor in parallel about amplifiers 82 and 86. Thus, 470 Kohm resistor 124 is connected in parallel with 33 pf capacitor 126 between the output of amplifier 82 and its inverting input. Similarly valued resistor 128 and capacitor 130 are connected in parallel between the output of amplifier 86 and its inverting input. These components, in combination with resistors 120 and 122, each having a value of 470, Kohm cause a decrease in gain of cross-fed components having a frequency greater than 10 KHz.

The output of amplifiers 82 and 86 are connected to the output of the imaging circuit through output resistor 132 and coupling capacitor 134, and output resistor 136 and coupling capacitor 138, respectively.

Note that the embodiment illustrated in FIG. 5 produces symmetric out-of-phase cross-feeding between channels. In many instances as set forth above, it is desirable that the cross-feeding be asymmetric. This can be accomplished by replacing either amplifier 82 or amplifier 86 and its associated feedback network with the circuitry illustrated in FIG. 6.

In FIG. 6, amplifier 140 has a feedback network connected between its output and its inverting input consisting of resistor 142 and capacitor 144 having values similar to components in the feedback networks associated with amplifiers 82 and 86. Connected to the inverting input of amplifier 140 is switch 146. Connected to the other terminal of switch 146 is one terminal of one megohm resistor 148 and 15 pf capacitor 150. The other terminals of resistor 148 and capacitor 150 are connected to the output of amplifier 140.

If amplifier 140 is substituted for amplifier 86 in the right channel and switch 146 is closed, typical right-handed asymmetric cross-feeding can be accomplished by closing switch 146. If amplifier 140 is substituted for amplifier 82 and switch 146 is closed, left-handed asymmetric cross-feeding can be accomplished by closing switch 146. In fact, an assembly as illustrated in FIG. 6 may be substituted for amplifier 82 and amplifier 86. The respective switches 146 may then be selectively closed to control whether right-handed asymmetric, left-handed asymmetric or symmetric cross-feeding will be produced.

Of course, if permanent right-handed or left-handed asymmetry is preferred, switch 146 may be removed. In fact, resistors 142 and 148 and capacitors 144 and 150 may be replaced by a single 320 Kohm resistor connected in parallel with a 48 pf capacitor, although these component values are not standard.

In the feedback network associated with amplifier 140 in FIG. 6, the critical frequency above which cross-feeding is eliminated remains the same even when resistor 148 and capacitor 150 are connected, since the product of the equivalent resistance for resistors 142 and 148 and the equivalent capacitance of capacitors 144 and 150 remains the same as the product of resistance 124 (or 128) and capacitance 126 (or 130). Nevertheless, the addition of resistor 148 and capacitor 150 introduces the asymmetry also found in the embodiment illustrated in FIG. 3.

With the embodiment illustrated in FIG. 6, amplifier 140 provides a relatively greater gain for the channel connected to its non-inverting input and relatively less gain for the cross-fed signals fed thereto than does amplifier 82 or 86. This is the cause of the asymmetry. However, with the embodiments illustrated in FIGS. 5 and 6, when both channels are applied with input signals of equal levels, the levels of the output signals are also equal.

While only a few exemplary embodiments of this invention has been described in detail above, those skilled in the art will readily appreciate that many variations and modifications may be made in these exemplary embodiments without materially departing from the novel features and advantages of this invention. Accordingly, all such variations and modifications are intended to be included within the scope of the following appended claims.

What is claimed is:

1. An audio signal processing circuit for processing plural channels of related audio signals, said circuit comprising:

a first audio signal processing channel;

a second audio signal processing channel; and asymmetric cross-feed means for feeding signal levels from the first to second channel and from the second to first channel that are substantially different in relative magnitude thus producing asymmetric bi-directional audio signal cross-feed between said first and second channels and an asymmeric output from said channels when different signals are applied to said first and second channels while causing said first and second channels to produce the same output when the same signal is applied to both said channels.

2. An audio signal processing circuit as in claim 1 including means for combining the cross-fed signal components in an out-of-phase relationship with respect to related audio signals already passing through a given channel.

3. An audio signal processing channel as in claim 1 wherein one of said channels provides a relatively greater gain for its own channel audio signals and relatively less for the cross-fed signals fed thereto than does the other one of said channels.

4. An audio signal processing channel as in claim 2 wherein said channels each comprise a pair of cascaded amplifiers, at least one of which amplifiers has a second differential input connected to said asymmetric cross-feed means.

5. An audio signal processing channel as in claim 3 wherein said asymmetric cross-feed means comprises a pair of substantially differently valued resistances, each connected to feed audio signals from a respective different one of said channels to the opposite channel.

6. A stereophonic audio signal processing circuit comprising:

a left audio signal processing channel, a right signal processing channel, and asymmetric audio signal cross-feed means connected to feed respectively different relative magnitudes of audio signals in each direction between said left and right channels and to combine the thus cross-fed signal component in a given channel with an out-of-phase relationship to the audio signals already passing through said given channel to produce an asymmetric output when different signals are applied to said channels, said cross-feed means also causing said right and left channels to produce the same output when the same signal is applied to both said channels.

7. A stereophonic audio signal processing circuit as in claim 6 wherein one of said channels provides a relatively greater gain for its own channel audio signals and relatively less gain for the crossfed signals fed thereto than does the other one of said channels.

8. A stereophonic audio signal processing circuit as in claim 6 wherein each of said channels comprises a pair of cascaded amplifiers, at least one of which amplifiers has a second differential input connected to said asymmetric audio signal cross-feed means.

9. A stereophonic audio signal processing circuit as in claim 7 wherein said asymmetric audio signal cross feed-means comprises a pair of substantially differently valued resistances, each connected to feed audio signals from a respectively different one of said channels to the opposite channel.

10. Apparatus for processing related audo frequency electrical signals in plural signal channels so as to provide more accurately located psychoacoustic images when the electrical signals in each signal channel are simultaneously transduced to acoustic signals by a corresponding electro-acoustic transducer, said apparatus comprising:

a first audio frequency electrical signal processing channel having a predetermined first gain for passing first audio signals from a first channel input to a first channel output and having a first auxiliary input for accepting first additional audio signals to be combined out-of-phase at said first channel output with said first audio signals, a second audio frequency electrical signal processing channel having a predetermined second gain for passing second audio signals from a second channel input to a second channel output and having a second auxiliary input for accepting second additional audio signals to be combined-out-of-phase at said second channel output with said second audio signals, first cross-feed means connected between said channels for feeding a first predetermined portion of said first audio signal to said second auxiliary input, and second cross-feed means connected between said channels for feeding a second predetermined portion of said second audio signal to said first auxiliary input, said second predetermined portion being substantially different from said first predetermined portion to produce an asymmetric output when different signals are applied to said channels, said first and second channels and said first and second cross-feed means cooperating to cause said first and second channels to produce the same output when the same signal is applied to both channels.

11. Apparatus as in claim 10 wherein each said cross-feed means has a substantially frequency independent response characteristic in the audio frequency range.

12. Apparatus as in claim 10 adapted to enhance psychoacoustic image recovery for a listener having a predetermined half brain dominance wherein a corresponding one of said channels is caused to provide a relatively greater gain for its own channel audio signals and relatively less for its auxiliary input out-of-phase audio signals than does the other one of said channels.

13. Apparatus as in claim 10 wherein each of said first and second audio frequency electrical signal processing channels comprises a pair of cascaded amplifiers, at least one of which amplifiers has a second differential input which serves as the auxiliary input for that channel.

14. Apparatus as in claim 13 wherein said first and second cross-feed means each comprise a resistor and wherein such respective resistors have substantially different resistance values.

15. Apparatus as in claim 14 wherein said gains and cross-fed signal portions produce equal channel output levels when presented with equal level channel input signals.

16. A method for enhancing the psychoacoustic image perceived by a listener from a plural channel audio reproduction system having at least left and right speakers corresponding to said channels and positioned to the left and right of the listener respectively and where a predetermined half of the listener's brain possesses predominance, said method comprising the steps of:

combining a predetermined relative proportion of audio signals emanating from the left channel with those of the right channel in an out-of-phase relationship with the thus combined signals being passed on in the right channel to drive said right speaker; and combining a different predetermined proportion of audio signals emanating from the right channel with those of the left channel in an out-of-phase relationship with the thus combined signals being passed on in the left channel to drive said left speaker;

said different predetermined proportions being chosen to provide a relatively greater gain in the channel corresponding to the listener's dominant brain half for that channel's own signal and relatively less gain for the cross-fed signals thereto than does the other one of said channels.

17. A method as in claim 16 wherein said combining steps are performed so as to produce equal left and right channel output signal levels when equal left and right channel input signal levels are presented.

18. An audio signal processing circuit as in claim 1, further comprising means for limiting said cross-feed to components of said signal levels below a predetermined frequency.

19. An audio signal processing circuit as in claime 18 wherein said limiting means predetermined frequency is 10 KHz.

20. A stereophonic audio signal processing circuit as in claim 16 further comprising means for limiting said cross-feed to components of said signal levels below a predetermined frequency.

21. A method for enhancing the psychoacoustic image perceived by a listener from a plural channel audio reproduction system as in claim 16 further comprising the step of limiting said combining steps to those components of said audio signal below a predetermined frequency.

22. A method as in claim 21 wherein said predetermined frequency is 10 KHz.

23. A method for enhancing the psychoacoustic image perceived by a listener from a plural channel audio reproduction system having at least left and right speakers corresponding to said channels and positioned to the left and right of the listener respectively and where a predetermined half of the listener's brain possesses predominance, said method comprising the steps of:

combining a predetermined relative proportion of audio signals emanating from the left channel with those of the right channel in an out-of-phase relationship with the thus combined signals being passed on in the right channel to drive said right speaker;

combining a different predetermined proportion of audio signals emanating from the right channel with those of the left channel in an out-of-phase relationship with the thus combined signals being passed on in the left channel to drive said left speaker;

said different predetermined proportions being chosen to provide a relatively greater gain in the channel corresponding to the listener's dominant brain half for that channel's own signal and relatively less gain for the cross-fed signals thereto than does the other one of said channels; and limiting said combining steps to those components of said audio signal below a predetermined frequency.

24. A method as in claim 23 wherein said predetermined frequency is 10 KHz.

* * * * *